US012630778B2

(12) United States Patent
Parker et al.

(10) Patent No.: US 12,630,778 B2
(45) Date of Patent: May 19, 2026

(54) DETERGENT-FREE AND LOW-ASH LUBRICATING COMPOSITION

(71) Applicant: Afton Chemical Corporation, Richmond, VA (US)

(72) Inventors: Mariah Parker, Richmond, VA (US); Jason Bell, Powhatan, VA (US); Kenneth Garelick, Mechanicsville, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/541,023

(22) Filed: Dec. 15, 2023

(65) Prior Publication Data

US 2024/0209277 A1 Jun. 27, 2024

Related U.S. Application Data

(63) Continuation-in-part of application No. 18/068,795, filed on Dec. 20, 2022, now Pat. No. 12,146,115.

(51) Int. Cl.

| | |
|---|---|
| ***C10M 137/02*** | (2006.01) |
| ***C10M 133/16*** | (2006.01) |
| *C10N 20/02* | (2006.01) |
| *C10N 30/00* | (2006.01) |
| *C10N 40/25* | (2006.01) |

(52) U.S. Cl.

CPC ..... *C10M 137/02* (2013.01); *C10M 133/16* (2013.01); *C10M 2215/28* (2013.01); *C10N 2020/02* (2013.01); *C10N 2030/45* (2020.05); *C10N 2040/25* (2013.01)

(58) Field of Classification Search

CPC ..... C10M 137/02; C10M 133/16; C10M 141/10; C10M 161/00; C10M 2215/042; C10M 2215/28; C10M 2207/281; C10M 2207/283; C10M 2215/086; C10M 2215/10; C10M 2205/02; C10M 2223/045; C10M 2207/289; C10M 2215/224; C10M 2207/026; C10M 2215/064; C10M 2223/047; C10M 2207/288; C10M 2215/066; C10M 2207/282; C10N 2030/45; C10N 2060/14; C10N 2020/02; C10N 2030/02; C10N 2030/52; C10N 2030/04; C10N 2030/12; C10N 2030/24; C10N 2040/25

See application file for complete search history.

(56) References Cited

U.S. PATENT DOCUMENTS

| | | | |
|---|---|---|---|
| 2,237,625 | A | 4/1941 | Olin |
| 2,237,627 | A | 4/1941 | Olin |
| 2,527,948 | A | 10/1950 | Lyon, Jr. et al. |
| 2,695,316 | A | 11/1954 | Mcbride |
| 2,995,569 | A | 8/1961 | Hamilton et al. |
| 3,022,351 | A | 2/1962 | Mihm et al. |
| 3,219,666 | A | 11/1965 | Norman et al. |
| 3,308,166 | A | 3/1967 | Biensan et al. |
| 3,392,201 | A | 7/1968 | Warner |
| 3,471,404 | A | 10/1969 | Myers |
| 3,502,677 | A | 3/1970 | Le Sner |
| 3,565,804 | A | 2/1971 | Honnen et al. |
| 3,634,515 | A | 1/1972 | Piasek et al. |
| 3,673,090 | A | 6/1972 | Waldbillig et al. |
| 3,697,429 | A | 10/1972 | Engel et al. |
| 3,697,574 | A | 10/1972 | Piasek et al. |
| 3,703,504 | A | 11/1972 | Horodysky |
| 3,703,505 | A | 11/1972 | Horodysky et al. |
| 3,736,357 | A | 5/1973 | Piasek et al. |
| 3,763,244 | A | 10/1973 | Shubkin |
| 3,796,661 | A | 3/1974 | Suratwala |
| 3,816,346 | A | 6/1974 | Coppock et al. |
| 3,873,454 | A | 3/1975 | Horodysky et al. |
| 3,991,056 | A | 11/1976 | Okamoto et al. |
| 4,036,771 | A | 7/1977 | Denis et al. |
| 4,118,329 | A | 10/1978 | Hotten |
| 4,119,549 | A | 10/1978 | Davis |
| 4,119,550 | A | 10/1978 | Davis et al. |
| 4,147,640 | A | 4/1979 | Jayne et al. |
| 4,191,659 | A | 3/1980 | Davis |
| 4,204,969 | A | 5/1980 | Papay et al. |
| 4,218,332 | A | 8/1980 | Schwab et al. |
| 4,234,435 | A | 11/1980 | Meinhardt et al. |
| 4,240,958 | A | 12/1980 | Braid |
| 4,282,392 | A | 8/1981 | Cupples et al. |
| 4,285,822 | A | 8/1981 | deVries et al. |

(Continued)

FOREIGN PATENT DOCUMENTS

| | | | |
|---|---|---|---|
| EP | 0088453 | A1 | 9/1983 |
| EP | 612839 | A1 | 8/1994 |

(Continued)

OTHER PUBLICATIONS

International Search Report and Written Opinion issued in Application No. PCT/US2023/084180 mailed on Apr. 8, 2024, 12 pages.

Takeuchi et al., Investigation of Engine Oil Effect on Abnormal Combustion in Turbocharged Direct Injection-Spark Ignition Engines, SAE Int., Nov. 2012, vol. 5, Issue 3.

Haenel et al., Systematic Approach to Analyze and Characterize Pre-ignition Events in Turbocharged Direct-injected Gasoline Engines, SAE Int., Apr. 2011.

Takeuchi et al., Investigation of Engine Oil Effect on Abnormal Combustion in Turbocharged Direct Injection-Spark Ignition Engines, SAE Int., Nov. 2012, vol. 5, Issue 3. (Abstract).

(Continued)

*Primary Examiner* — Ishal V Vasisth

(74) *Attorney, Agent, or Firm* — Honigman LLP

(57) ABSTRACT

This disclosure describes detergent-free and low-ash lubricating composition achieving piston cleanliness with one or more succinimide dispersants, one or more ashless antiwear additives, and one or more antioxidants when selected ratios of sulfur, phosphorus, and nitrogen are maintained.

21 Claims, No Drawings

(56) References Cited

U.S. PATENT DOCUMENTS

| | | | | |
|---|---|---|---|---|
| 4,344,854 | A | 8/1982 | Davis et al. | |
| 4,472,306 | A | 9/1984 | Powers et al. | |
| 4,537,696 | A | 8/1985 | Beimesch | |
| 4,564,709 | A | 1/1986 | Koyama et al. | |
| 4,587,368 | A | 5/1986 | Pratt | |
| 4,636,322 | A | 1/1987 | Nalesnik | |
| 4,711,736 | A | 12/1987 | Horodysky et al. | |
| 4,747,971 | A | 5/1988 | Erdman | |
| 4,795,576 | A | 1/1989 | Born et al. | |
| 4,857,214 | A | 8/1989 | Papay et al. | |
| 4,925,983 | A | 5/1990 | Steckel | |
| 4,941,984 | A | 7/1990 | Chamberlin, III et al. | |
| 4,954,274 | A | 9/1990 | Zaweski et al. | |
| 4,956,122 | A | 9/1990 | Watts et al. | |
| 4,966,720 | A | 10/1990 | DeGonia et al. | |
| 4,992,183 | A | 2/1991 | Beimesch et al. | |
| 5,089,156 | A | 2/1992 | Chrisope et al. | |
| 5,114,602 | A | 5/1992 | Petrille et al. | |
| 5,266,223 | A | 11/1993 | Song et al. | |
| 5,439,605 | A * | 8/1995 | Khorramian | C10M 143/12 508/202 |
| 5,614,480 | A | 3/1997 | Salomon et al. | |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,936,041 | A | 8/1999 | Diana et al. | |
| 6,117,825 | A * | 9/2000 | Liu | C10M 133/58 508/293 |
| 6,124,247 | A | 9/2000 | Cazin et al. | |
| 6,303,546 | B1 | 10/2001 | Hata et al. | |
| 8,260,530 | B2 | 9/2012 | Rollinger et al. | |
| 8,327,687 | B2 | 12/2012 | Amann et al. | |
| 8,404,624 | B2 | 3/2013 | Ribeaud | |
| 8,543,315 | B2 | 9/2013 | Glugla et al. | |
| 9,481,696 | B1 | 11/2016 | Edwards et al. | |
| 11,034,912 | B2 | 6/2021 | Ritchie et al. | |
| 11,214,750 | B2 | 1/2022 | Milner | |
| 2002/0165102 | A1 | 11/2002 | Hata et al. | |
| 2004/0242434 | A1 | 12/2004 | Yagishita et al. | |
| 2005/0101496 | A1 | 5/2005 | Loper et al. | |
| 2006/0058200 | A1 | 3/2006 | Shaw et al. | |
| 2006/0217271 | A1 | 9/2006 | Brown et al. | |
| 2007/0184992 | A1 | 8/2007 | Takeuchi et al. | |
| 2008/0128184 | A1 | 6/2008 | Loper et al. | |
| 2009/0156446 | A1 | 6/2009 | McAtee et al. | |
| 2010/0009876 | A1 * | 1/2010 | Kamano | C10M 141/06 508/280 |
| 2011/0111997 | A1 | 5/2011 | Cook et al. | |
| 2011/0213538 | A1 | 9/2011 | Amann et al. | |
| 2011/0265761 | A1 | 11/2011 | Amann et al. | |
| 2011/0297122 | A1 * | 12/2011 | Bardasz | F02M 43/00 123/299 |
| 2012/0029789 | A1 | 2/2012 | Mehta et al. | |
| 2012/0101017 | A1 | 4/2012 | Duggal | |
| 2012/0186225 | A1 | 7/2012 | Amann et al. | |
| 2013/0035841 | A1 | 2/2013 | Glugla et al. | |
| 2014/0187453 | A1 | 7/2014 | Umehara et al. | |
| 2014/0187455 | A1 | 7/2014 | Umehara et al. | |
| 2014/0194329 | A1 | 7/2014 | Shimizu et al. | |
| 2015/0322367 | A1 | 11/2015 | Patel et al. | |
| 2015/0322369 | A1 | 11/2015 | Patel et al. | |
| 2016/0230116 | A1 | 8/2016 | Mosier et al. | |
| 2016/0281020 | A1 | 9/2016 | Yamamoto et al. | |
| 2017/0015926 | A1 | 1/2017 | Fletcher et al. | |
| 2017/0015930 | A1 | 1/2017 | Fletcher | |
| 2017/0022441 | A1 | 1/2017 | Onodera | |
| 2017/0175027 | A1 * | 6/2017 | Gieselman | C10M 133/56 |
| 2018/0002631 | A1 | 1/2018 | Milner | |
| 2021/0371767 | A1 | 12/2021 | Shimizu et al. | |

FOREIGN PATENT DOCUMENTS

| | | | |
|---|---|---|---|
| EP | 1788068 | A1 | 5/2007 |
| EP | 1985690 | A2 | 10/2008 |
| EP | 2639433 | A1 | 9/2013 |
| GB | 961009 | A | 6/1964 |
| GB | 1162334 | | 8/1969 |
| GB | 1162334 | A | 8/1969 |
| JP | 2014152301 | A | 8/2014 |
| JP | 2016534216 | A | 11/2016 |
| JP | 2017514984 | A | 6/2017 |
| JP | 2017149830 | A | 8/2017 |
| JP | 201821107 | A | 2/2018 |
| JP | 2018168344 | A | 11/2018 |
| WO | 2009104682 | A1 | 8/2009 |
| WO | 2015023559 | A1 | 2/2015 |
| WO | 2015042337 | A1 | 3/2015 |
| WO | 2015042340 | A1 | 3/2015 |
| WO | 2015042341 | A1 | 3/2015 |
| WO | 2015076417 | A1 | 5/2015 |
| WO | 20150114920 | A1 | 8/2015 |
| WO | 2017011691 | A1 | 1/2017 |
| WO | 2020085228 | A1 | 4/2020 |

OTHER PUBLICATIONS

Haenel et al., Systematic Approach to Analyze and Characterize Pre-ignition Events in Turbocharged Direct-injected Gasoline Engines, SAE Int., Apr. 2011. (Abstract).

W. W. Yau, J. J. Kirkland and D. D. Bly, "Modern Size Exclusion Liquid Chromatography", John Wiley and Sons, New York, 1979.

* cited by examiner

DETERGENT-FREE AND LOW-ASH LUBRICATING COMPOSITION

CROSS-REFERENCE TO RELATED APPLICATION

The present application claims priority to and is a continuation-in-part of U.S. application Ser. No. 18/068,795 filed on Dec. 20, 2022, now U.S. Pat. No. 12,146,115 which is incorporated herein by reference in its entirety.

TECHNICAL FIELD

This disclosure relates to detergent-free and low-ash additive systems and lubricating compositions including the additive systems configured for improved piston cleanliness.

BACKGROUND

Automotive manufacturers continue to push for improved efficiency and fuel economy, and as such, demands on engines, lubricants, and their components continue to increase. This continued push for fuel economy improvements, in some instances, has shifted the automotive market towards direct-injection gasoline (DIG) engines; however, one of the shortcomings of DIG technology is the possibility for increased exhaust particulates and, in particular, increased levels of soot and/or ash. One option to mitigate the increased soot and/or ash is the use of gasoline particulate filters (GPF) to remove such particulates from exhaust, but such use is not without tradeoffs. Although a fouled GPF can regenerate, in some circumstances, by burning off collected soot particles, the GPF generally cannot purge collected levels of ash, which tends to be the result of small amounts of engine oil burned in the combustion chamber, and thus, the GPF may have a limited lifespan. Alternatively, there is often a desire to simply decrease the levels of soot and/or ash contributions from a lubricant, but reducing these contributors and still meeting the heightened demands of manufacturer and industry performance standards tends to be challenging. While lower ash-contributing components in a lubricant may be desirable, in many instances, reducing the ash-contributing components (such as detergents and/or antiwear additives) tends to degrade other performance characteristics of the lubricant.

Ash containing components in the engine oil are usually specified by sulfate ash (SASH) limits. Engine oils often have SASH limits of up to 1 weight percent. However, formulating engine oils to meet lower SASH limits, such as below 0.2 weight percent, is often challenging due to the reduced performance of the oil when removing some of the major ash contributing species from the engine oil. In particular, calcium, magnesium, sodium, and/or lithium are examples of major ash-contributing metals typically provided in detergent additives used in engine oils. Detergent additives are commonly included in engine oils for their ability to clean metal surfaces, such as pistons. It is believed that detergents function by acting as surface active agents that can remove deposits from the metal surfaces, but for this functionality to occur, the detergents generally need to be metal salts and, therefore, also contribute a level of ash to the lubricant in order to perform their intended function. Thus, limiting these major ash-contributing species in engine oils to achieve lower SASH targets also tends to limit the ability of the low-ash engine oil in achieving acceptable levels of piston cleanliness.

SUMMARY

In one approach or embodiment, a detergent-free and low-ash lubricating composition (as those ingredients as defined herein) is described that provides good piston cleanliness. In one aspect, the compositions include one or more base oils of lubricating viscosity; a total sulfated ash (SASH) as measured by ASTM D874 of less than about 0.2 weight percent; one or more succinimide dispersants derived from a polyisobutylene having a number average molecular weight of at least about 1000, wherein the succinimide dispersants each have up to about 2 weight percent of nitrogen and wherein at least one of the succinimide dispersants is post treated with a boron compound; one or more ashless antiwear additives; and one or more antioxidants. In other aspects, the compositions also have a total base number (TBN) pursuant to ASTM D2896 of at least about 4; at least about 1000 ppm of nitrogen, no more than 100 ppm of boron, no more than 800 ppm of sulfur, and a sulfur-to-phosphorus ratio of 2.0 or less, and a ratio of nitrogen-to-TBN of about 150 or greater; and wherein the detergent-free, low ash lubricating composition is substantially free of calcium, barium, copper, lead, lithium, magnesium, sodium, molybdenum, zinc, and potassium. In yet other aspects, substantially free in the contexts of the present disclosure means the detergent-free and low-ash lubricating compositions herein further have less than about 10 ppm of each of calcium, barium, copper, lead, lithium, magnesium, sodium, molybdenum, zinc, and potassium.

In yet other embodiments, the composition of the preceding paragraph may have other features or embodiments in any combination. These other features or embodiments may include one or more of the following: further comprising no more than about 500 ppm of phosphorus and no more than about 600 ppm of sulfur; and/or wherein the composition includes at least about 6 times more of the one or more antioxidants relative to the one or more ashless antiwear additives; and/or wherein the total sulfated ash (SASH) measured pursuant to ASTM D874 is less than about 0.1 weight percent; and/or wherein the one or more ashless antiwear additives includes one or more ashless dialkyl dithiophosphate antiwear additives; and/or wherein the one or more ashless, dialkyl dithiophosphate antiwear additives have a structure of Formula I, or a salt thereof:

(Formula I)

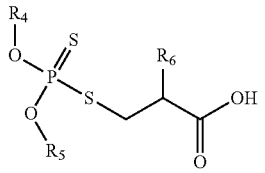

wherein $R_4$ and $R_5$ are, independently, a C3 to C8 linear or branched alkyl group, and $R_6$ is —H or —$CH_3$; and/or wherein the one or more antioxidants includes an aminic antioxidant, a hindered phenolic antioxidant, or combinations thereof; and/or wherein the aminic antioxidant is selected from the group comprising aromatic amines, alkylated diphenyl amines, alkyl diphenylamine, di-alkyl diphenylamine, octyl diphenylamine, di-octyl diphenylamine, phenyl-alpha-naphthylamines, alkylated phenyl-alpha-naphthylamines, hindered non-aromatic amines, or combinations thereof; and/or wherein the one or more succinimide dispersants includes (i) a succinimide dispersant derived from a polyisobutylene having a number average molecular weight of about 1000 to about 2000 and post treated with a boron compound; (ii) a succinimide dispersant derived from a polyisobutylene having a number average molecular weight greater than about 2000; and (iii) a succinimide derived from a polyisobutylene having a number average molecular weight of 1000 to about 2000; and/or wherein more than 50 weight percent of the total nitrogen is provided by the one or more antioxidants; and/or further comprising a dispersant olefin copolymer viscosity index improver including the reaction product of an acylated olefin copolymer and a polyamine, wherein the acylated olefin copolymer includes an olefin copolymer having grafted thereon about 0.3 to about 0.75 carboxylic groups per 1000 number average molecular weight units of the olefin copolymer, wherein the olefin copolymer has a number average molecular weight of about 40,000 to about 150,000, and wherein the polyamine is a N-arylphenylenediamine; and/or wherein the lubricating composition includes about 1 weight percent to about 4 weight percent of the dispersant olefin copolymer viscosity index improver; and/or wherein the total amounts of the nitrogen, the sulfur, and the phosphorus relative to the amount of boron (N+S+P)/B is about 20 to about 50; and/or wherein the lubricating composition cleans up piston deposits pursuant to the Sequence IIIH Engine Test (ASTM D8111) with a merit rating of at least about 4 total weighted piston deposits, and wherein the lubricating composition exhibits an average engine varnish (AES) of at least 8 merits and/or an average engine sludge rating of at least 7.6 merits pursuant to the Sequence VH test (ASTM D8256).

In other approaches or embodiments, the present disclosure also provides for a method of lubricating a combustion engine using a detergent-free and low-ash ash lubricating composition (as those components are defined herein). In aspects, the methods herein include lubricating a combustion engine with a detergent-free and low-ash lubricating composition; wherein the detergent-free, low ash lubricating composition includes one or more base oils of lubricating viscosity; a total sulfated ash (SASH) as measured by ASTM D874 of less than about 0.2 weight percent; one or more succinimide dispersants derived from a polyisobutylene having a number average molecular weight of at least about 1000, wherein the succinimide dispersants each have up to about 2 weight percent of nitrogen and wherein at least one of the succinimide dispersants is post treated with a boron compound; one or more ashless antiwear additives; one or more antioxidants; a total base number (TBN) pursuant to ASTM D2896 of at least about 4; at least about 1000 ppm of nitrogen, no more than 100 ppm of boron, no more than 800 ppm of sulfur, and a sulfur-to-phosphorus ratio of 2.0 or less, and a ratio of nitrogen-to-TBN of about 150 or greater; and wherein the detergent-free, low ash lubricating composition is substantially free of calcium, barium, copper, lead, lithium, magnesium, sodium, molybdenum, zinc, and potassium. In other aspects, the method of lubricating with the lubricating compositions herein cleans up piston deposits pursuant to the Sequence IIIH Engine Test (ASTM D8111) with a merit rating of at least about 4 total weighted piston deposits, and wherein the lubricating composition exhibits an average engine varnish (AES) of at least 8 merits and/or an average engine sludge rating of at least 7.6 merits pursuant to the Sequence VH test (ASTM D8256).

In yet other approaches or embodiments, the methods described in the previous paragraph may include other features, method steps, or embodiments in any combination. These other features, method steps, or embodiments may include one or more of the following: wherein the compositions further include less than about 10 ppm of each of calcium, barium, copper, lead, lithium, magnesium, sodium, molybdenum, zinc, and potassium; and/or further comprising no more than about 500 ppm of phosphorus and no more than about 600 ppm of sulfur; and/or wherein the composition includes at least about 6 times more of the one or more antioxidants relative to the one or more ashless antiwear additives; and/or wherein the total sulfated ash (SASH) measured pursuant to ASTM D874 is less than about 0.1 weight percent; and/or wherein the one or more ashless antiwear additives includes one or more ashless dialkyl dithiophosphate antiwear additives; and/or wherein the one or more ashless, dialkyl dithiophosphate antiwear additives have a structure of Formula I, or a salt thereof:

(Formula I)

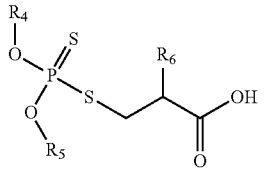

wherein $R_4$ and $R_5$ are, independently, a C3 to C8 linear or branched alkyl group, and $R_6$ is —H or —$CH_3$; and/or wherein the one or more antioxidants includes an aminic antioxidant, a hindered phenolic antioxidant, or combinations thereof; and/or wherein the aminic antioxidant is selected from the group comprising aromatic amines, alkylated diphenyl amines, alkyl diphenylamine, di-alkyl diphenylamine, octyl diphenylamine, di-octyl diphenylamine, phenyl-alpha-naphthylamines, alkylated phenyl-alpha-naphthylamines, hindered non-aromatic amines, or combinations thereof; and/or wherein the one or more succinimide dispersants includes (i) a succinimide dispersant derived from a polyisobutylene having a number average molecular weight of about 1000 to about 2000 and post treated with a boron compound; (ii) a succinimide dispersant derived from a polyisobutylene having a number average molecular weight greater than about 2000; and (iii) a succinimide derived from a polyisobutylene having a number average molecular weight of 1000 to about 2000; and/or wherein more than 50 weight percent of the total nitrogen is provided by the one or more antioxidants; and/or further comprising a dispersant olefin copolymer viscosity index improver including the reaction product of an acylated olefin copolymer and a polyamine, wherein the acylated olefin copolymer includes an olefin copolymer having grafted thereon about 0.3 to about 0.75 carboxylic groups per 1000 number average molecular weight units of the olefin copolymer, wherein the olefin copolymer has a number average molecular weight of about 40,000 to about 150,000, and wherein the polyamine is a N-arylphenylenediamine; and/or wherein the lubricating composition includes about 1 weight percent to about 4 weight percent of the dispersant olefin copolymer viscosity index improver; and/or wherein the total amounts of the nitrogen, the sulfur, and the phosphorus relative to the amount of boron (N+S+P)/B is about 20 to about 50.

In yet other approaches or embodiments, the present disclosure describes the use of any embodiment of the detergent-free and low-ash lubricating compositions of this Summary for cleaning up piston deposits pursuant to the Sequence IIIH Engine Test (ASTM D8111) and achieving a merit rating of at least about 4 total weighted piston deposits and/or for achieving an average engine varnish (AES) of at least 8 merits and/or for achieving an average engine sludge rating of at least 7.6 merits pursuant to the Sequence VH test (ASTM D8256).

In approaches of the use described in the previous paragraph, the detergent-free and low-ash lubricating composition (as those ingredients as defined herein) includes any embodiment of this summary and, in particular, includes one or more base oils of lubricating viscosity; a total sulfated ash (SASH) as measured by ASTM D874 of less than about 0.2 weight percent; one or more succinimide dispersants derived from a polyisobutylene having a number average molecular weight of at least about 1000, wherein the succinimide dispersants each have up to about 2 weight percent of nitrogen and wherein at least one of the succinimide dispersants is post treated with a boron compound; one or more ashless antiwear additives; and one or more antioxidants. In other aspects, the compositions also have a total base number (TBN) pursuant to ASTM D2896 of at least about 4; at least about 1000 ppm of nitrogen, no more than 100 ppm of boron, no more than 800 ppm of sulfur, and a sulfur-to-phosphorus ratio of 2.0 or less, and a ratio of nitrogen-to-TBN of about 150 or greater; and wherein the detergent-free, low ash lubricating composition is substantially free of calcium, barium, copper, lead, lithium, magnesium, sodium, molybdenum, zinc, and potassium. In yet other aspects, substantially free in the contexts of the use in the present disclosure means the detergent-free and low-ash lubricating compositions herein further have less than about 10 ppm of each of calcium, barium, copper, lead, lithium, magnesium, sodium, molybdenum, zinc, and potassium.

Additional details and advantages of the disclosure will be set forth in part in the description that follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Sulfated ash is a measurement that indicates the total weight percent of ash in a lubricating oil composition. The sulfated ash measurement for a lubricating oil composition is related to the total metal content therein and may be conveniently measured according to ASTM D874 and/or other common evaluation methods known in the art and as described herein. In one aspect, this disclosure describes low-ash additives and lubricants including such additives providing an extremely low sulfated ash (SASH) content of about 0.2 weight percent or less, about 0.1 weight percent or less, about 0.08 weight percent or less, about 0.06 weight percent or less, or about 0.05 weight percent or less of sulfated ash content in a lubricating oil composition. In another aspect, this disclosure also describes additives and lubricants that are also free of detergent additives and, thus, free of the metals provided by the detergents. As used herein, the detergent-free and low-ash lubricating compositions herein not only have the low SASH levels noted above, but are also detergent free meaning the compositions are free of detergent metals including calcium, magnesium, sodium, and lithium. Additionally, the compositions herein are also free of barium, copper, lead, molybdenum, zinc, and potassium that are other ash contributing elements. As used herein, "free of" in the context of detergents and/or the noted metals and minerals means that the compositions herein have about 10 ppm or less of each element, metal, or mineral (e.g., calcium, magnesium, sodium, lithium, barium, copper, lead, molybdenum, zinc, and/or potassium), about 5 ppm or less, about 2 ppm or less, about 1 ppm or less, or no detectable amounts of such element, metal, or mineral in the composition. Even without conventional detergent additives and the associated metal salts from those detergents acting as surface active agents, the compositions herein surprisingly achieve desired levels of piston cleanliness through careful selection of elemental relationships of the remaining componentry in the compositions.

Turning to more of the specifics and in some embodiments, the detergent-free and low-ash lubricating compositions herein include at least one or more base oils of lubricating viscosity; a total sulfated ash (SASH) as measured by ASTM D874 of less than about 0.2 weight percent; one or more succinimide dispersants derived from a polyisobutylene having a number average molecular weight of at least about 1000, wherein the succinimide dispersant(s) each have up to about 2 weight percent of nitrogen and wherein (if more than one is included) at least one of the succinimide dispersants is post treated with a boron compound; one or more ashless antiwear additives; one or more antioxidants; a total base number (TBN) pursuant to ASTM D2896 of at least about 4; at least about 1000 ppm of nitrogen, no more than 100 ppm of boron, no more than 800 ppm of sulfur, a sulfur-to-phosphorus ratio of 2.0 or less, and a ratio of nitrogen-to-TBN of about 150 or greater; and wherein the detergent-free and low-ash lubricating composition is free of calcium, barium, copper, lead, lithium, magnesium, sodium, molybdenum, zinc, and/or potassium as defined above. In other embodiments, the detergent-free and low-ash lubricating composition also has a weight ratio of total amounts of nitrogen, total amount of sulfur, and total amount phosphorus relative to total amounts of boron (N+S+P)/B of about 20 to about 50.

In yet other embodiments, the detergent-free and low-ash lubricating compositions herein may have limited amounts of phosphorus, sulfur, and certain relationships of the antioxidants to the antiwear additives. For instance, the detergent-free and low-ash lubricants herein may also have no more than about 500 ppm of phosphorus, no more than about 600 ppm of sulfur, and/or may also have at least about 6 times more of the one of more antioxidants relative to the one or more ashless antiwear additives.

As shown in the Examples below, such embodiments of the detergent-free and low-ash lubricating compositions herein are effective to clean up piston deposits even without the use of conventional detergent additives when measured pursuant to the Sequence IIIH Engine Test (ASTM D8111) with a merit rating of at least about 4 total weighted piston deposits, and/or the embodiments herein of the detergent-free and low-ash lubricating compositions also exhibit an average engine varnish (AES) of at least 8 merits and/or an average engine sludge rating of at least 7.6 merits pursuant to the Sequence VH test (ASTM D8256).

Ashless Antiwear Additive

In approaches or embodiments, the detergent-free and low-ash lubricating compositions herein include one or more ashless antiwear additives in the form of an acidic thiophosphate or a thiophosphate ester, such as an ashless, amine free dialkyl dithiophosphate acid ester or sulfur-containing phosphoric acid ester. In embodiments, the one or more ashless antiwear additives provide about 100 ppm to about 500 ppm of antiwear phosphorus to the lubricating composition, in other approaches, about 150 ppm to about 450 ppm of antiwear phosphorus, in further approaches, about 200 ppm to about 400 ppm, or in yet other approaches, about 300 ppm to about 390 ppm of the antiwear phosphorus. In alternative approaches, the detergent-free and low-ash lubricating compositions herein include about 0.1 weight percent to about 0.5 weight percent of the one or more ashless antiwear additives, in other approaches, about 0.2 weight percent to about 0.48 weight percent, in further approaches, or about 0.3 weight percent to about 0.45 weight percent of the one or more ashless antiwear additives. As the compositions herein are preferably free of conventional ZDDP additives (i.e., such as, in some embodiments, about 10 ppm or less of zinc from ZDDP, or no detectable amounts of ZDDP additives), the detergent-free and low-ash lubricating compositions herein also preferably include 80 to 100 weight percent, and more preferably, 90 to 100 weight percent, and most preferably all of the phosphorus and/or sulfur in the lubricant being provided by this ashless antiwear additive.

In some embodiments, the one or more ashless antiwear additives herein are an acidic thiophosphate, a thiophosphate ester, or a sulfur-containing phosphoric acid esters and may have one or more sulfur to phosphorus bonds. The thiophosphorus acid esters may be dithiophosphorus acid esters. In more specific approaches, the acidic thiophosphate or thiophosphate ester may have a structure of Formula I or a salt thereof (Formula I)

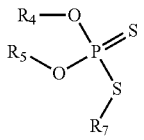

wherein $R_4$ and $R_5$ are each, independently, a linear or branched C1 to C10 hydrocarbyl group and $R_7$ is a C1 to C10 linear or branched carboxylic group or a C1 to C10 linear or branched alkyl alkanoate group. Preferably, $R_4$ and $R_5$ are each a C3 to C8 linear or branched alkyl group and $R_7$ is derived from 2-methyl proponoic acid such that the second phosphorus product (or a salt thereof) has the structure of Formula Ia below:

(Formula Ia)

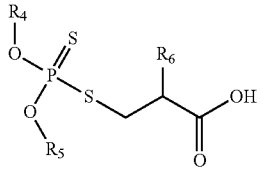

wherein $R_4$ and $R_5$ are, independently, a C3 to C8 linear or branched alkyl group (preferably, a branched C4 group), and $R_6$ is —H or —$CH_3$. In some approaches or embodiments, the one or more ashless antiwear additives includes at least 3-[[bis(2-methylpropoxy) phosphinothioyl]thio]-2-methylpropanoic acid.

Antioxidants

In other approaches or embodiments, the detergent-free and low-ash lubricating compositions herein also include one or more antioxidants, which preferably are selected from an aminic antioxidant, a hindered phenolic antioxidant, or combinations thereof. As noted above, embodiments herein may include about 6 times more of the one or more antioxidants relative to the one or more ashless antiwear additives to achieve the desired piston cleanliness in the context of lubricants that are detergent-free and low-ash.

In one approach or embodiment, the aminic antioxidants may include, but are not limited to, antioxidants selected from aromatic amines, alkylated diphenylamines, phenyl-α-napthylamines, alkylated phenyl-α-naphthylamines, hindered non-aromatic amines, and the like, or combinations thereof. The total amount of the aminic antioxidant in the detergent-free and low-ash lubricating compositions herein is in an amount to deliver at least about 650 ppm of antioxidant nitrogen and, in some approaches, about 670 ppm to about 800 ppm antioxidant nitrogen, in other approaches, about 690 to about 750 ppm of antioxidant nitrogen, or in yet further approaches, about up to about 700 ppm of antioxidant nitrogen. In other approaches, the detergent-free and low-ash lubricating compositions herein may include up to about 3 weight percent of the aminic antioxidant, or about 1 to about 3 weight percent of the aminic antioxidant. In some approaches, the nitrogen from the aminic antioxidant contributes at least half of the nitrogen in the lubricant and, for example, contributes at least about 50 weight percent of the total nitrogen in the detergent-free and low-ash lubricant, and in other approaches, about 50 to about 60 weight percent of the total nitrogen in the detergent-free and low-ash lubricant composition.

In some approaches, the aminic antioxidant may be one or more aromatic amine antioxidants and may include, but are not limited to, diarylamines having the formula:

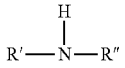

wherein R' and R" each independently represents a substituted or unsubstituted aryl group having from 6 to 30 carbon atoms. If substituted, suitable substituents for the aryl group of R' and R" include aliphatic hydrocarbon groups such as alkyl having from 1 to 30 carbon atoms, hydroxy groups, halogen radicals, carboxylic acid or ester groups, or nitro groups. The aryl group may be substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. In approaches, one or both aryl groups may be substituted, e.g. mono-alkylated diphenylamine, di-alkylated diphenylamine, C9 alkylated diphenyl amines, or mixtures of mono- and di-alkylated diphenylamines.

Examples of diarylamine antioxidants that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyl-diphenylamine, monooctyldiphenylamine, dioctyldiphenylamine, monononyl-diphenylamine, dinonyldiphenylamine, monotetradecyldiphenylamine, ditetradecyl-diphenylamine, phenyl-alpha-naphthylamine, monooctyl phenyl-alpha-naphthylamine, phenyl-beta-naphthylamine, monoheptyldiphenylamine, diheptyl-diphenylamine, p-oriented styrenated diphenylamine, mixed butyloctyldiphenylamine, and mixed octylstyryl-diphenylamine.

Suitable hindered phenol antioxidants may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, for instance, Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

In some embodiments, the detergent-free and low-ash lubricating compositions herein may also include about 0.5 to about 1 weight percent of the hindered phenol antioxidants, and in other embodiments, about 0.5 to about 0.8 weight percent of hindered phenol antioxidants. Preferably, when the detergent-free and low-ash lubricating compositions include both the aminic antioxidant and the hinderied phenol antioxidant, then the compositions have at least about 3 time more of the aminic antioxidant then the hindered phenol antioxidant (on a weight basis), and preferably about 3 to about 4 time more of the aminic antioxidant then the hindered phenol antioxidants (on a weight basis).

One or more Succinimide Dispersants

The detergent-free and low-ash lubricating compositions herein also include a dispersant system including one or more succinimide dispersants derived from polyisobutylene having an number average molecular weight of at least about 1000 and, when more than one succinimide dispersant is included, at least one of the dispersants in the system is post treated with a boron compound. In embodiments, less than half of the lubricant nitrogen is provided by the dispersants, and preferably about 40 to less than 50 percent of the lubricant nitrogen is provided by the one or more succinimide dispersants. In approaches, the succinimide dispersants provide about 600 to less than about 700 ppm of nitrogen to the lubricants herein.

In one approach, the one or more succinimide dispersants includes (i) a succinimide dispersant derived from a polyisobutylene having a number average molecular weight of about 1000 to less than about 2000 and post-treated with a boron compound; (ii) a succinimide dispersant derived from a polyisobutylene having a number average molecular weight greater than about 2000 and not post-treated with boron; and (iii) a succinimide derived from a polyisobutylene having a number average molecular weight of 1000 to about 2000 and not post-treated with a boron compound.

Succinimide dispersants are often known as ashless-type dispersants because, prior to mixing in a lubricating composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of nitrogen-substituted long chain alkenyl succinimides include polyisobutylene succinimide with the number average molecular weight of the polyisobutylene substituent being in the range about 1,000 to about 50,000, or to about 5,000, or to about 3,000, or to about 2,000 to about 3,000 as measured by GPC. Succinimide dispersants and their preparation are disclosed, for instance in U.S. Pat. Nos. 7,897,696 or 4,234,435, which are incorporated herein by reference. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

In approaches, preferred amines for the dispersants herein may be selected from polyamines and hydroxylamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like. In some approaches, a so-called heavy polyamine may be used, which is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogen atoms per molecule and with 2 or more primary amines per molecule.

In some embodiments, polyisobutylene (PIB), when included in the dispersants herein, is a preferred reactant to form the dispersants and may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 1,000 to about 3,000 may be suitable, as determined by GPC or, preferably about 1,200 to about 3,000 or within the ranges noted above. Such HR-PIB is commercially available, or can be synthesized by the polymerization of isobutene in the presence of a non-chlorinated catalyst such as boron trifluoride, as described in U.S. Pat. Nos. 4,152,499 and/or 5,739,355. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696. In one embodiment, the present disclosure further comprises at least one dispersant derived from polyisobutylene succinic anhydride ("PIBSA"). The PIBSA may have an average of between about 1.0 and about 2.0 succinic acid moieties per polymer.

In some approaches, some of the dispersants in the detergent-free and low-ash lubricating compositions herein may be free of any post-treatments, such as post treatments with boron, urea, thiourea, dimercapto thiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compound. In other embodiments, at least one of the dispersants in the detergent-free and low-ash lubricating compositions herein may be post-treated by conventional methods by a reaction with any of a variety of post-treat agents. In one approach, at least one of the dispersants in the compositions herein may be post treated with a boron compound. Suitable post treat agents include boron, urea, thiourea, dimercapto thiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. (See, e.g., U.S. Pat. Nos. 7,645,726; 7,214,649; 8,048,831; and 5,241,003, which are all incorporated herein by reference in their entireties.)

If post treated with boron, the boron compound used as a post-treating reagent can be selected from boron oxide, boron halides, boron acids and esters of boron acids in an amount to provide from about 0.1 atomic proportion of boron for each mole of the nitrogen composition to about 20 atomic proportions of boron for each atomic proportion of nitrogen used. The dispersant post-treated with boron may contain from about 0.05 weight percent to about 2.0 weight percent, or in other approaches, about 0.05 weight percent to about 0.7 weight percent boron, based on the total weight of the borated dispersant.

In other approaches and if used, the carboxylic acid may also be used as a post-treating reagent and can be saturated or unsaturated mono-, di-, or poly-carboxylic acid. Examples of carboxylic acids include, but are not limited to, maleic acid, fumaric acid, succinic acid, and naphthalic diacid (e.g., 1,8-naphthalic diacid). Anhydrides can also be used as a post-treating reagent and can be selected from the group consisting of mono-unsaturated anhydride (e.g., maleic anhydride), alkyl or alkylene-substituted cyclic anhydrides (e.g., succinic anhydride or glutamic anhydride), and aromatic carboxylic anhydrides (including naphthalic anhydride, e.g., 1,8-naphthalic anhydride).

In one embodiment and if used, the process of post-treating the dispersant includes first forming the succinimide product, as described above, and then further reacting the succinimide product with the post treating agent, such as a boron compound, such as boric acid. In some cases, the dispersants herein may be post-treated with more than one post-treatment agents. For example, the dispersant may be post-treated with a boron compound, such as boric acid, and also an anhydride, such as maleic anhydride and/or 1,8-naphthalic anhydride.

In embodiments, the detergent-free and low-ash lubricating compositions herein may include at least about 5 weight percent of the one or more dispersants herein or about 5 to about 15 weight percent, preferably about 5 to about 10 weight percent, or more preferably, about 5 to about 8 weight percent of the one or more dispersants as described herein.

The Low-Ash Compositions

As noted above, the detergent-free and low-ash lubricant compositions herein are formulated to have extremely low levels of sulfated ash, and include an additive package providing a composition with sulfated ash levels (ASTM D874) of about 0.2 weight percent or less, about 0.1 weight percent or less, about 0.08 weight percent or less, about 0.06 weight percent or less, or about 0.05 weight percent or less (ASTM D874). In other approaches, the lubricant compositions herein may also include about 0.01 weight percent or more of sulfated ash, about 0.02 weight percent or more, about 0.3 weight percent or more, or about 0.04 weight percent or more of sulfated ash (ASTM D874).

As used herein, "sulfated ash" or "SASH" refers to the amount of sulfated ash as measured using ASTM D874. Alternatively, sulfated ash may also be calculated based on the amount of metals in the lubricant. For example, sulfated ash (SASH) may optionally be calculated based on the total metallic elements that contribute to SASH in the lubricant composition adjusted by factors for each metallic type. The metals that contribute to SASH include (along with the adjustment factor) barium (1.7), boron (3.22), calcium (3.4), copper (1.252), lead (1.464), lithium (7.92), magnesium (4.95), manganese (1.291), molybdenum (1.5), potassium (2.33), sodium (3.09), and zinc (1.5). Specifically, the ppmw content of each of the metallic elements present in a lubricating oil composition that is considered to contribute to sulfated ash is multiplied by its corresponding factor above; then, the product for each metallic element/factor adjustment is summed and the total is divided by 10,000 to calculate the weight percent of SASH in the lubricating compositions. Unless specified otherwise, all sulfated ash levels herein are measured using ASTM D874.

To achieve such low content of sulfated ash, the lubricant compositions herein have a select additive package providing an additive mixture with no detergent additives (as described and defined above) providing little to no calcium, magnesium, lithium, sodium, and other detergent metals and only low or select amounts of other compounds providing boron, molybdenum, and/or zinc. To this end, the lubricants herein preferably include additives providing no more than about 100 ppm of boron (preferably no more than about 90 ppm of boron or no more than about 80 ppm of boron) and 10 ppm or less of each of calcium, barium, copper, lead, lithium, magnesium, zinc, sodium, molybdenum, and/or combinations thereof. In other approaches, the lubricating compositions herein are substantially free of metallic detergents and, more preferably, the lubricating composition have metal detergents providing less than about 10 ppm of individual and/or total detergent metals, less than 8 ppm of individual or total detergent metals, less than 5 ppm of individual or total detergent metals, less than 2 ppm of individual or total detergent metals, less than 1 ppm of individual or total detergent, or no detectable amounts of detergent metals where detergent metals are selected from calcium, magnesium, sodium, lithium, and the like. In other approaches, the lubricating oil compositions herein are also substantially free of metal dialkyldithiophosphates (such as zinc dialkyldithiopohosphates) and, in such context, preferably have about 10 ppm or less of zinc provided by such metal dialkyldithiophosphate.

In other embodiments, the detergent-free and low-ash lubricating compositions also maintain a weight ratio of total sulfur to total phosphorus of less than about 2.0, and preferably about 1.0 to about 1.8. As noted above, the phosphorus and sulfur are provided by the ashless antiwear additives.

In yet other embodiments, the detergent-free and low-ash lubricating compositions herein have a total base number (TBN) as measured pursuant to ASTM D2898 of at least about 4 mg KOH/g, in other embodiments, about 4 to about 10 mg KOH/g, and in yet further embodiments, about 4 to about 6 mg KOH/g.

In yet other approaches, the detergent-free and low-ash lubricating compositions herein have a unique relationship between the total amount of nitrogen relative to the composition's TBN. For instance, the compositions herein may have a ratio of nitrogen to TBN of greater than 150 ppm per mg $KOHg^{-1}$, in other approaches, about 200 to about 350 ppm per mg $KOHg^{-1}$, and in other approaches, about 280 to about 325 ppm per mg $KOHg^{-1}$. Examples of calculating this ratio are provided in the Examples herein.

In further approaches or embodiments, the detergent-free and low-ash lubricating compositions herein may also have an elemental relationship between the total amounts of nitrogen, sulfur, phosphorus, and boron that are uniquely discovered to impact piston cleanliness in the context of lubricating compositions being detergent-free and low-ash as those features are described above. For instance and in one embodiment, the detergent-free and low-ash lubricating compositions may have a weight ratio of total nitrogen, total sulfur, and total phosphorus to total boron (i.e., (N+S+P)/B) of about 20 to about 50 and, more preferably, about 22 to about 30 to aid in achieving the piston cleanliness with the low metal and ash contents as described herein.

Lubricating Oil Compositions

The additives herein are combined with a major amount of a base oil or base oil blend of lubricating viscosity (as described below) in combination with one or more further optional additives to produce a lubricating oil composition. In approaches, the lubricating oil compositions includes about 50 weight percent or more of the base oil blend, about 60 weight percent or more, about 70 weight percent or more, or about 80 weight percent or more to about 95 weight percent or less, about 90 weight percent or less, about 85 weight percent or less of the base oil blend as such blend is further discussed below. The lubricating compositions herein may have a KV100 of about 2 to about 15 cSt (ASTM D445), and preferably, about 5 to about 12 cSt, and more preferably 5 to about 10 cSt.

When the detergent-free and low-ash lubricating compositions herein are combined with the noted components and elemental relationships, the lubricating compositions herein achieve desired levels of piston cleanliness even without the use of conventional detergent additives. As noted above, embodiments of the lubricating compositions herein clean up piston deposits pursuant to the Sequence IIIH Engine Test (ASTM D8111) with a merit rating of at least about 4 total weighted piston deposits (with higher ratings referring to a cleaner piston at the conclusion of the test), and embodiments of the lubricating compositions herein also exhibit an average engine varnish (AES) of at least 8 merits and/or an average engine sludge rating of at least 7.6 merits pursuant to the Sequence VH test (ASTM D8256).

Base Oil Blend: The base oil used in the detergent-free and low-ash lubricating oil compositions herein may be oils of lubricating viscosity and selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene-isobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Optional Additives:

The detergent-free and low-ash lubricating oil compositions herein may also include a number of optional additives. Those optional additives are described in the following paragraphs.

Boron-Containing Compounds: Subject to the discussions above on boron contents, the detergent-free and low-ash lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Extreme Pressure Agents: The detergent-free and low-ash lubricating compositions herein may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers: The detergent-free and low-ash lubricating compositions herein may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Transition Metal-containing compounds: In another embodiment and subject to the discussion above on total metal contents, the detergent-free and low-ash lubricants herein may optionally include a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

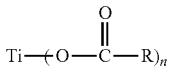

wherein n is an integer selected from 2, 3 and 4, and R is a hydrocarbyl group containing from about 5 to about 24 carbon atoms, or by the formula:

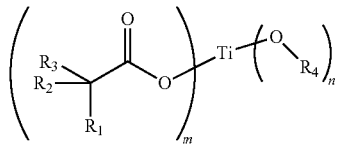

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

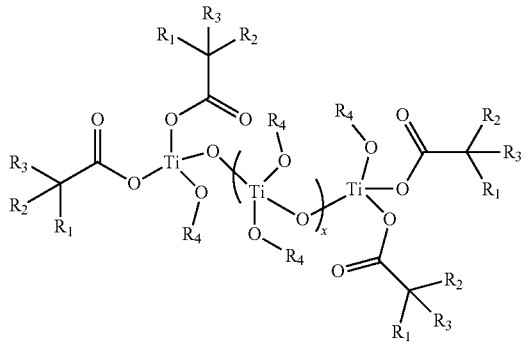

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers: The detergent-free and low-ash lubricating oil compositions herein may optionally contain one or more viscosity index improvers, such as a dispersant olefin copolymer viscosity index improper. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

In one approach, a suitable dispersant olefin copolymer viscosity index improver includes the reaction product of an acylated olefin copolymer and a polyamine, wherein the acylated olefin copolymer includes an olefin copolymer having grafted thereon about 0.3 to about 0.75 carboxylic groups per 1000 number average molecular weight units of the olefin copolymer, and wherein the olefin copolymer has a number average molecular weight of about 40,000 to about 150,000, and wherein the polyamine is a N-arylphenylene diamine. In optional approaches, the detergent-free and low-ash lubricating compositions includes about 1 weight percent to about 4 weight percent of the dispersant olefin copolymer viscosity index improver.

Other Optional Additives: Other additives may be selected to perform one or more functions required of a lubricating fluid. Further, one or more of the mentioned additives may be multi-functional and provide functions in addition to or other than the function prescribed herein. The other performance additives may be in addition to specified additives of the present disclosure and/or may comprise one or more of metal deactivators, viscosity index improvers, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives subject to the above discussions on components, amounts, and relationships of various compositions ingredients.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable additional rust inhibitors may be a single compound or a mixture of compounds having the property of inhibiting corrosion of ferrous metal surfaces. Additional rust inhibitors may be provided so long as they do not conflict with the selected corrosion inhibitors discussed above. Non-limiting examples of rust inhibitors, in addition to those described above, include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable detergent-free and low-ash lubricant herein may include additive components in the ranges listed in the following table.

TABLE 2

Suitable Low-Ash Lubricating Compositions

| Component | Wt. % (Suitable Embodiments) | Wt. % (Suitable Embodiments) |
|---|---|---|
| Succinimide Dispersant(s) | 5.0-10.0 | 5.0-8.0 |
| Antioxidant(s) | 0.3-4.0 | 0.5-3.0 |
| Detergent(s) | — | — |
| Antiwear (ashless) | 0.3-1.0 | 0.3-0.5 |
| Ashless TBN booster(s) | 0.0-1.0 | 0.01-0.5 |
| Other Corrosion inhibitor(s) | 0.0-5.0 | 0.0-2.0 |
| Metal-containing Antiwear | — | — |
| Antifoaming agent(s) | 0.0-5.0 | 0.001-0.15 |
| Pour point depressant(s) | 0.0-5.0 | 0.01-1.5 |
| Viscosity index improver(s) | 0.0-25.0 | 0.1-15.0 |
| Dispersant viscosity index improver(s) | 0.0-10.0 | 0.0-5.0 |
| Friction modifier(s) | 0.0-5.0 | 0.01-2.0 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

Lubricants herein are configured for use in various types of lubricants, such as automotive lubricants and/or greases, internal combustion engine oils, hybrid engine oils, electric engine lubricants, drivetrain lubricants, transmission lubricants, gear oils, hydraulic lubricants, tractor hydraulic fluids, metal working fluids, turbine engine lubricants, stationary engine lubricants, tractor lubricants, motorcycle lubricants, power steering fluids, clutch fluids, axles fluids, wet break fluids, and the like. Suitable engine types may include, but are not limited to heavy-duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression-ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines. Engines may be coupled with a turbocharger.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, sulfonates, and/or phenols.

The term "alkaline earth metal" relates to calcium, barium, magnesium, and strontium, and the term "alkali metal" refers to lithium, sodium, potassium, rubidium, and cesium.

As used herein, the term "hydrocarbyl" or "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

As used herein, the term "ppm" or "ppmw," unless expressly stated otherwise, refers to parts per million based on weight.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896.

The term "alkyl" as employed herein refers to straight, branched, cyclic, and/or substituted saturated chain moieties of from about 1 to about 100 carbon atoms. The term "alkenyl" as employed herein refers to straight, branched, cyclic, and/or substituted unsaturated chain moieties of from about 3 to about 10 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

As used herein, "post-reacted" or "post-treated" refers to a component that is further reacted with or treated with, for example, a boron, phosphorus, and/or maleic anhydride and may refer to dispersants in which primary and/or secondary amines are further reacted with such compounds to convert at least a portion of such amines to tertiary amines. Such subsequent reactions or treatments are further described in U.S. Pat. No. 5,241,003, which is incorporated herein by reference. Conversely, components that are "not post-reacted" or "not post-treated" have not been subjected to such further processing, reactions, and/or treatments and, in the context of dispersants, include a certain amount of primary and/or secondary amines.

The molecular weight for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, incorporated herein by reference.

As used herein, "sulfated ash" or "SASH" refers to the amount of sulfated ash as measured using ASTM D874. Alternatively, sulfated ash may also be calculated based on the amount of metals in the lubricant. For example, sulfated ash (SASH) may optionally be calculated based on the total metallic elements that contribute to SASH in the lubricant composition adjusted by factors for each metallic type. The metals that contribute to SASH include (along with the adjustment factor) barium (1.7), boron (3.22), calcium (3.4), copper (1.252), lead (1.464), lithium (7.92), magnesium (4.95), manganese (1.291), molybdenum (1.5), potassium (2.33), sodium (3.09), and zinc (1.5). Specifically, the ppmw content of each of the metallic elements present in a lubricating oil composition that is considered to contribute to sulfated ash is multiplied by its corresponding factor above; then, the product for each metallic element/factor adjustment is summed and the total is divided by 10,000 to calculate the weight percent of SASH in the lubricating compositions. Unless specified otherwise, all sulfated ash levels herein are measured using ASTM D874.

EXAMPLES

A better understanding of the present disclosure and its many advantages may be clarified with the following example. The following example is illustrative and not limiting thereof in either scope or spirit. Those skilled in the art will readily understand that variations of the components, methods, steps, and devices described in these examples can be used. Unless noted otherwise or apparent from the context of discussion in the Example below and throughout this disclosure, all percentages, ratios, and parts noted in this disclosure are by weight.

To demonstrate how a detergent-free and low-ash lubricant as defined herein can achieve suitable performance as a passenger car motor oil when selecting elemental relationships rather than incorporation of new additives, Inventive and Comparative passenger car motor oils were evaluated for high temperature deposits (TEOST-33) as measured pursuant to ASTM D6335, total weighted piston deposits (WPD) of the Sequence IIIH test of ASTM D8111, and average engine sludge (AES) and average engine varnish (AEV) of the Sequence VH tests of ASTM D8256. The passenger car motor oils of this Example all included similar amounts of antifoam additives, process oil, pour point dispersants, viscosity modifiers, and Group III base oils to form lubricants having a kV100 viscosity (ASTM D445) of about 10 to about 12 cSt. The Comparative and Inventive lubricants also included the following additives of Table 1 and the fluid relationships of Table 2 below when including the following additives:

Dispersant Disp-1: a succinimide dispersant from a polyisobutylene having a number average molecular weight of about 1000 to about 2000 and post treated with a boron compound.

Dispersant Disp-2: a succinimide dispersant derived from a polyisobutylene having a number average molecular weight greater than about 2000.

Dispersant Disp-3: a succinimide dispersant derived from a polyisobutylene having a number average molecular weight of 1000 to about 2000.

Detergent 1 (Det-1): overbased calcium sulfonate having a TBN of about 300.

Detergent 2 (Det-2): overbased magnesium sulfonate having a TBN of about 400.

Antiwear 1 (AW 1): 3-[[bis(2-methylpropoxy) phosphinothioy]thio]-2-methyl-propanoic acid Antiwear 2 (AW 2): a zinc dialkyldithiophosphate with 100% of the alkyl groups derived from a primary alcohol.

Antiwear 3 (AW 3): a zinc dialkyldithiophosphate with 100% of the alkyl groups derived from a secondary alcohol.

Antioxidant 1 (AO 1): di-alkyl diphenylamine antioxidant.

Antioxidant 2 (AO 2): phenolic ester antioxidant.

Antioxidant 3 (AO3): molybdenum-containing antioxidant.

Antioxidant 4 (AO 4): sulfur-containing antioxidant.

Viscosity Modifier (DOCP1): dispersant olefin copolymer viscosity modifier grafted with N-arylphenylenediamine having a number average MW of 40,000 to 150,000.

TABLE 1

| Fluid Compositions | | | |
|---|---|---|---|
| | Inventive 1 | Compare 2 | Compare 2 |
| DISP 1 | 0.8% | 0.9% | 3% |
| DISP 2 | 2.8% | 1.8% | 1.5% |
| DISP 3 | 2% | — | — |
| DET 1 | — | 1% | 1.1% |
| DET 2 | — | 0.4% | 0.6% |
| AW 1 | 0.4% | — | — |
| AW 2 | — | 0.2% | 0.2% |
| AW 3 | — | 0.7% | 0.9% |
| AO 1 | 2% | 1% | 0.8% |
| AO 2 | 0.6% | — | — |
| AO 3 | — | 0.05% | 0.7% |
| AO 4 | — | — | 0.6% |
| DOCP 1 | 2% | — | — |

TABLE 2

| Fluid Relationships | | | | |
|---|---|---|---|---|
| | | Inventive 1 | Compare 1 | Compare 2 |
| KV100° C. (D445) | cSt | 10.9 | 9.8 | 10.6 |
| B | ppm | 87 | 58 | 237 |
| Ca | ppm | 1 | 1246 | 1296 |
| Mg | ppm | 4 | 368 | 559 |
| Mo | ppm | 0 | 51 | 80 |
| P | ppm | 359 | 626 | 737 |
| Zn | ppm | 0 | 693 | 812 |
| Nitrogen | ppm | 1340 | 730 | 978 |
| S | ppm | 536 | 1845 | 2710 |
| TBN (D2896) | mg KOH/g | 4.2 | 6.9 | 8 |
| Total Dispersant | wt % | 5.6 | 2.7 | 4.5 |
| Total Detergent | wt % | 0 | 1.4 | 1.7 |
| Nitrogen:TBN | | 319 | 106 | 122 |
| S:P | | 1.49 | 2.95 | 3.68 |
| (N + S + P)/B | | 25.7 | 55.2 | 18.7 |
| AO relative to AW | | 6.5x | 1.1x | 1.3x |
| Nitrogen from AO | ppm | 700 | 350 | 280 |
| % N from AO | | 52.2% | 47.8% | 28.6% |

TABLE 3

| Piston Cleanliness | | | | |
|---|---|---|---|---|
| | | Inventive 1 | Compare 1 | Compare 2 |
| Sulfated Ash (D874) | % | 0.06 | 0.72 | 0.84 |
| Deposits (D6335) | Mg | 28.1 | 21.3 | 24.7 |
| WPD (D8111) | merit | 4.45 | 4.22 | 4.16 |
| AES (D8256) | merit | 9.33 | 7.71 | 8.41 |
| AEV (D8256) | merit | 9.77 | 9.09 | 9.27 |

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A detergent-free and low-ash lubricating composition comprising:

one or more base oils of lubricating viscosity;

a total sulfated ash (SASH) as measured by ASTM D874 of less than about 0.2 weight percent;

about 5 weight percent to about 15 weight percent of one or more succinimide dispersants providing about 600 to about 700 ppm nitrogen to the detergent-free and low-ash lubricating composition and derived from a polyisobutylene having a number average molecular weight of at least about 1000, wherein the succinimide dispersants each have up to about 2 weight percent of nitrogen and wherein at least one of the succinimide dispersants is post treated with a boron compound, wherein the one or more succinimide dispersants includes (i) a succinimide dispersant derived from a polyisobutylene having a number average molecular weight of about 1000 to about 2000 and post treated with a boron compound; (ii) a succinimide dispersant derived from a polyisobutylene having a number average molecular weight greater than about 2000; and (iii) a succinimide derived from a polyisobutylene having a number average molecular weight of 1000 to about 2000;

about 0.1 to about 0.5 weight percent of one or more ashless antiwear additives, wherein the one or more ashless, antiwear additives have a structure of Formula I, or a salt thereof:

(Formula I)

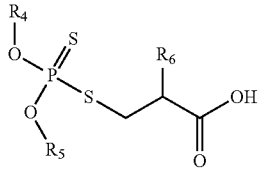

wherein $R_4$ and $R_5$ are, independently, a C3 to C8 linear or branched alkyl group, and $R_6$ is —H or —$CH_3$;

one or more antioxidants, wherein the one or more antioxidants includes an aminic antioxidant, a hindered phenolic antioxidant, or combinations thereof and wherein the composition includes at least about 6 times more of the one or more antioxidants relative to the one or more ashless antiwear additives;

about 1 weight percent to about 4 weight percent of a dispersant olefin copolymer viscosity index improver;

a total base number (TBN) pursuant to ASTM D2896 of at least about 4;

at least about 1000 ppm of nitrogen, no more than 100 ppm of boron, no more than 800 ppm of sulfur, and a sulfur-to-phosphorus ratio of 2.0 or less, and a ratio of nitrogen-to-TBN of about 150 or greater;

wherein the detergent-free, low ash lubricating composition is substantially free of calcium, barium, copper, lead, lithium, magnesium, sodium, molybdenum, zinc, and potassium; and wherein more than 50 weight percent of the total nitrogen is provided by the one or more antioxidants.

2. The detergent-free and low-ash lubricating composition of claim 1, further comprising no more than about 500 ppm of phosphorus and no more than about 600 ppm of sulfur.

3. The detergent-free and low-ash lubricating composition of claim 1, wherein the total sulfated ash (SASH) measured pursuant to ASTM D874 is less than about 0.1 weight percent.

4. The detergent-free and low-ash lubricating composition of claim 1, wherein the aminic antioxidant is selected from the group comprising aromatic amines, alkylated diphenyl amines, alkyl diphenylamine, di-alkyl diphenylamine, octyl diphenylamine, di-octyl diphenylamine, phenyl-alpha-naphthylamines, alkylated phenyl-alpha-naphthylamines, hindered non-aromatic amines, or combinations thereof.

5. The detergent-free and low-ash lubricating composition of claim 1, wherein more than 50 weight percent of the total nitrogen is provided by the one or more antioxidants.

6. The detergent-free and low-ash lubricating composition of claim 1, further comprising a dispersant olefin copolymer viscosity index improver including the reaction product of an acylated olefin copolymer and a polyamine, wherein the acylated olefin copolymer includes an olefin copolymer having grafted thereon about 0.3 to about 0.75 carboxylic groups per 1000 number average molecular weight units of the olefin copolymer, wherein the olefin copolymer has a number average molecular weight of about 40,000 to about 150,000, and wherein the polyamine is a N-arylphenylenediamine.

7. The detergent-free and low-ash lubricating composition of claim 1, wherein the total amounts of the nitrogen, the sulfur, and the phosphorus relative to the amount of boron (N+S+P)/B is about 20 to about 50.

8. The detergent-free and low-ash lubricating composition of claim 1, wherein the lubricating composition cleans up piston deposits pursuant to the Sequence IIIH Engine Test (ASTM D8111) with a merit rating of at least about 4 total weighted piston deposits, and wherein the lubricating composition exhibits an average engine varnish (AES) of at least 8 merits and/or an average engine sludge rating of at least 7.6 merits pursuant to the Sequence VH test (ASTM D8256).

9. A method of lubricating a combustion engine using a detergent-free and low-ash ash lubricating composition, the method comprising:

lubricating a combustion engine with a detergent-free and low-ash lubricating composition; wherein the detergent-free, low ash lubricating composition includes one or more base oils of lubricating viscosity; a total sulfated ash (SASH) as measured by ASTM D874 of less than about 0.2 weight percent; about 5 weight percent to about 15 weight percent of one or more succinimide dispersants providing about 600 to about 700 ppm nitrogen to the detergent-free and low-ash lubricating composition and derived from a polyisobutylene having a number average molecular weight of at least about 1000, wherein the succinimide dispersants each have up to about 2 weight percent of nitrogen and wherein at least one of the succinimide dispersants is post treated with a boron compound, wherein the one or more succinimide dispersants includes (i) a succinimide dispersant derived from a polyisobutylene having a number average molecular weight of about 1000 to about 2000 and post treated with a boron compound; (ii) a succinimide dispersant derived from a polyisobutylene having a number average molecular weight greater than about 2000; and (iii) a succinimide derived from a polyisobutylene having a number average molecular weight of 1000 to about 2000; about 0.1 to about 0.5 weight percent of one or more ashless antiwear additives, wherein the one or more ashless, antiwear additives have a structure of Formula I, or a salt thereof:

(Formula I)

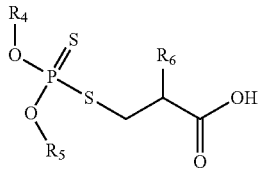

wherein $R_4$ and $R_5$ are, independently, a C3 to C8 linear or branched alkyl group, and $R_6$ is —H or —$CH_3$; one or more antioxidants, wherein the one or more antioxidants includes an aminic antioxidant, a hindered phenolic antioxidant, or combinations thereof and wherein the composition includes at least about 6 times more of the one or more antioxidants relative to the one or more ashless antiwear additives; a total base number (TBN) pursuant to ASTM D2896 of at least about 4; at least about 1000 ppm of nitrogen, no more than 100 ppm of boron, no more than 800 ppm of sulfur, and a sulfur-to-phosphorus ratio of 2.0 or less, and a ratio of nitrogen-to-TBN of about 150 or greater; and wherein the detergent-free, low ash lubricating composition is substantially free of calcium, barium, copper, lead, lithium, magnesium, sodium, molybdenum, zinc, and potassium; wherein more than 50 weight percent of the total nitrogen is provided by the one or more antioxidants; and about 1 weight percent to about 4 weight percent of a dispersant olefin copolymer viscosity index improver; and wherein the lubricating composition cleans up piston deposits pursuant to the Sequence IIIH Engine Test (ASTM D8111) with a merit rating of at least about 4 total weighted piston deposits, and wherein the lubricating composition exhibits an average engine varnish (AES) of at least 8 merits and/or an average engine sludge rating of at least 7.6 merits pursuant to the Sequence VH test (ASTM D8256).

10. The method of claim 1, further comprising no more than about 500 ppm of phosphorus and no more than about 600 ppm of sulfur.

11. The method of claim 9, wherein the total sulfated ash (SASH) measured pursuant to ASTM D874 is less than about 0.1 weight percent.

12. The method of claim 9, wherein the aminic antioxidant is selected from the group comprising aromatic amines, alkylated diphenyl amines, alkyl diphenylamine, di-alkyl diphenylamine, octyl diphenylamine, di-octyl diphenylamine, phenyl-alpha-naphthylamines, alkylated phenyl-alpha-naphthylamines, hindered non-aromatic amines, or combinations thereof.

13. The method of claim 9, wherein more than 50 weight percent of the total nitrogen is provided by the one or more antioxidants.

14. The method of claim 9, further comprising a dispersant olefin copolymer viscosity index improver including the reaction product of an acylated olefin copolymer and a polyamine, wherein the acylated olefin copolymer includes an olefin copolymer having grafted thereon about 0.3 to about 0.75 carboxylic groups per 1000 number average molecular weight units of the olefin copolymer, wherein the olefin copolymer has a number average molecular weight of about 40,000 to about 150,000, and wherein the polyamine is a N-arylphenylenediamine.

15. The method of claim 9, wherein the total amounts of the nitrogen, the sulfur, and the phosphorus relative to the amount of boron (N+S+P)/B is about 20 to about 50.

16. The detergent-free and low-ash lubricating composition of claim 1, wherein the sulfur-to-phosphorus ratio is 1.0 to 1.8 and the ratio of nitrogen-to-TBN is about 150 to about 350.

17. The method of claim 9, wherein the sulfur-to-phosphorus ratio is 1.0 to 1.8 and the ratio of nitrogen-to-TBN is about 150 to about 350.

18. The detergent-free and low-ash lubricating composition of claim 16, wherein less than half of the lubricant nitrogen is provided by the one or more succinimide dispersants.

19. The detergent-free and low-ash lubricating composition of claim 18, wherein the succinimide dispersants (ii) and (ii) are not post-treated with boron.

20. The method of claim 17, wherein less than half of the lubricant nitrogen is provided by the one or more succinimide dispersants.

21. The method of claim 20, wherein the succinimide dispersants (ii) and (ii) are not post-treated with boron.

* * * * *